US006705934B1

(12) United States Patent
Shiro et al.

(10) Patent No.: US 6,705,934 B1
(45) Date of Patent: Mar. 16, 2004

(54) POLISHING PAD

(75) Inventors: Kuniyasu Shiro, Shiga (JP); Kazuhiko Hashisaka, Kyoto (JP); Tetsuo Oka, Shiga (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/763,361

(22) PCT Filed: Aug. 25, 1999

(86) PCT No.: PCT/JP99/04584

§ 371 (c)(1),
(2), (4) Date: Feb. 21, 2001

(87) PCT Pub. No.: WO00/12262

PCT Pub. Date: Mar. 9, 2000

(30) Foreign Application Priority Data

Aug. 28, 1998 (JP) ..... 10-242899

(51) Int. Cl.[7] ..... B24D 3/28
(52) U.S. Cl. ..... 451/526; 451/41; 51/298
(58) Field of Search ..... 451/526, 527, 451/533, 921, 41; 51/298, 296

(56) References Cited

U.S. PATENT DOCUMENTS 6,017,265 A * 1/2000 Cook et al. ..... 451/41
6,022,264 A * 2/2000 Cook et al. ..... 451/37
6,069,080 A * 5/2000 James et al. ..... 438/691
6,293,852 B1 * 9/2001 Roberts et al. ..... 451/41

FOREIGN PATENT DOCUMENTS

| | | |
|---|---|---|
| EP | 0 713 897 | 11/1995 |
| JP | 61-76275 A | 4/1986 |
| JP | 2-88229 A | 3/1990 |
| JP | 5-505769 A | 8/1993 |
| JP | 6-220151 A | 8/1994 |
| JP | 7-164307 A | 6/1995 |
| JP | 7-297195 A | 11/1995 |
| WO | 96/15887 | 5/1996 |

OTHER PUBLICATIONS

Copy of European Search Report dated Jun. 20, 2002, EPO, Munich, Germany.

* cited by examiner

*Primary Examiner*—Robert A. Rose
(74) *Attorney, Agent, or Firm*—Morrison & Foerster LLP

(57) ABSTRACT

The present invention relates to a polishing pad which is characterized in that it is of micro rubber A-type hardness at least 80°, has closed cells of average cell diameter no more than 1000 $\mu$m, is of density in the range 0.4 to 1.1 and contains polyurethane and polymer produced from a vinyl compound. When planarizing local unevenness on a semiconductor substrate with the polishing pad relating to the present invention, the polishing rate is high, the global step height is low, dishing does not readily occur at the metallic interconnects, clogging and permanent set of the surface layer region do not readily occur and the polishing rate is stable.

14 Claims, No Drawings

POLISHING PAD

TECHNICAL FIELD

The present invention relates to a polishing pad and to a method of polishing semiconductor substrates where this is employed and, furthermore, it relates to a polishing pad for mechanically planarizing the surface of the insulating layers and metallic interconnects formed on silicon or other such semiconductor substrates.

BACKGROUND ART

Year by year, the mounting densities of large scale integrated circuits (LSIs) typified by semiconductor memories have increased and, along with this, the widths of the interconnects on the large scale integrated circuits have narrowed and the number of superimposed layers has increased. Due to this increase in the number of superimposed layers, while not an issue in the past, unevenness of the semiconductor wafer main face, produced as a result of the layering, has become a problem. As a result, as described in, for example, Nikkei Microdevice, July 1994, pp 50–57, semiconductor wafer planarization using chemical mechanical polishing (CMP) techniques has been investigated with the object of dealing with the inadequate depth of focus at the time of light exposure brought about by the unevenness produced by layering, or with the object of improving interconnect densities by planarizing through-hole regions.

Generally speaking, CMP equipment comprises a polishing head which holds the semiconductor wafer, which is the material being treated, a polishing pad for carrying out the polishing treatment of the material being treated and a polishing platen which holds this polishing pad. In the semiconductor wafer polishing treatment, the wafer surface layers are made smooth by effecting relative motion between the semiconductor wafer and the polishing pad, and removing the projecting portions on the semiconductor wafer surface layers, using a slurry consisting of abrasive particles and chemical liquid. The polishing rate of a semiconductor wafer, for example in the case of a silicon oxide ($SiO_2$) film formed on the main face of a semiconductor wafer, is roughly proportional to the relative speed between semiconductor wafer and polishing pad, and to the load. Thus, in order to carry out uniform polishing of each part of a semiconductor wafer, it is necessary to make the load applied to the semiconductor wafer uniform.

When insulating layers and the like formed on the main face of a semiconductor wafer are subjected to polishing, if the polishing pad is too soft then, the local planarity is adversely affected. For such reasons, at present a foamed polyurethane sheet of Shore A-type hardness not less than 90° is employed. However, with foamed polyurethane pads of high hardness, problems have arisen in that the degree of planarity varies between areas of different densities of unevenness of the insulating layers and the like, and a global step height is produced. There is also the problem that dishing (where the height of the central region of a metallic interconnect is lower than the edges) occurs when the width of Damascene-based metallic interconnects is large. Furthermore, there have also been problems in that the polishing agent is readily adsorbed and clogging tends to occur, or permanent set of the pad surface layer region is produced during the polishing, and so the polishing rate decreases.

OBJECTIVE OF THE INVENTION

The objective of the present invention lies in offering a polishing pad where, in the case of a polishing pad for mechanically flattening the surfaces of the insulating layers or metallic interconnects formed on a silicon substrate, the polishing rate is high, the global step height is low, dishing does not readily occur at the metallic interconnects, clogging and permanent set of the surface layer region do not tend to occur, and the polishing rate is stable.

DISCLOSURE OF THE INVENTION

The present invention has the following constitution.

"A polishing pad of micro rubber A-type hardness at least 80°, which contains polyurethane and polymer produced from a vinyl compound, and has closed cells of average cell diameter no more than 1000 μm and, furthermore, has a density in the range 0.4 to 1.1."

BEST MODE FOR CARRYING OUT THE INVENTION

Below, the form for practising the invention is explained.

Firstly, the micro rubber A-type hardness referred to in the present invention denotes the value evaluated using a micro rubber durometer MD-1 produced by the Kobunshi Keiki Co. Ltd. The micro rubber durometer MD-1 enables hardness measurements to be carried out on thin/small items where measurement has been difficult with conventional durometers, and because it has been designed and manufactured as a spring-system rubber durometer A-type model scaled down to approximately ⅕, measured values which are in agreement with the spring-system rubber durometer A-type hardness are obtained. Since the polishing layer or hard layer thickness in the case of ordinary polishing pads extends less than 5 mm, evaluation is not possible with a spring-system rubber A-type durometer and so evaluation is carried out with this micro rubber durometer, MD-1.

For the polishing pad of the present invention, a micro rubber A-type hardness of at least 80°, and preferably at least 90°, is necessary. If the micro rubber A-type hardness is not at least 80°, the planarity of the local unevenness on the semiconductor substrate is unsatisfactory, so this is undesirable.

Since the polishing pad of the present invention has closed cells, it possesses elasticity in the thickness direction and even when slurry aggregates and polishing debris are sandwiched between the surface undergoing polishing and the polishing pad, scratching can be prevented. It is necessary that the closed cell diameter be no more than 1000μ, as an average diameter, so that local unevenness is not brought about. No more than 500 μm is preferred, with no more than 30 μm still further preferred.

It is preferred that the polishing pad of the present invention has a density lying in the range 0.4 to 1.1. If the density is not at least 0.4, the local planarity is poor and there is a considerable global step height. If the density exceeds 1.1, scratching readily occurs. It is further preferred that the density lies in the range 0.6 to 0.9, with a density in the range 0.65 to 0.85 still more preferred.

The polyurethane in the polishing pad of the present invention is a polymer obtained from a polyisocyanate and a compound containing active hydrogen, specifically a hydroxy or amino group-containing compound with two or more active hydrogens. As examples of the polyisocyanate, there are tolylene diisocyanate, diphenylmethane diisocyanate, naphthalene diisocyanate, tolidine diisocyanate, hexamethylene diisocyanate and isophorone diisocyanate, but there is no restriction thereto. Polyols are typical of the polyhydroxy compounds, examples of which are polyether-polyols, polypropylene glycol, polytetramethylene ether glycol, epoxy resin-modified polyols, polyester polyols, acryl polyols, polybutadiene polyols, silicone polyols and the like. Of these, the polyurethanes obtained from a combination of tolylene diisocyanate or diphenylmethane diisocyanate, as the polyisocyanate, and polypropylene glycol or polytetramethylene ether glycol, as the polyol, are outstanding in their mouldability and are widely used, so are preferred.

The present invention is a polishing pad containing polyurethane and polymer produced from a vinyl compound, and which has closed cells. With a polyurethane, as the hardness is raised it becomes more brittle. Furthermore, while it is possible to raise the toughness and hardness merely using polymer from a vinyl compound, it has been difficult to obtain a homogenous polishing pad with closed cells. However, by incorporating polyurethane and polymer produced from a vinyl compound, it has been possible to produce a polishing pad of high toughness and hardness which contains closed cells.

In the present invention, a vinyl compound means a compound with a polymerizable carbon-carbon double bond. Specific examples are methyl methacrylate, ethyl methacrylate, propyl methacrylate, n-butyl methacrylate, isobutyl methacrylate, methyl(α-ethyl)acrylate, ethyl(α-ethyl)acrylate, propyl(α-ethyl)acrylate, butyl(α-ethyl) acrylate, 2-ethylhexyl methacrylate, isodecyl methacrylate, n-lauryl methacrylate, 2-hydroxyethyl methacrylate, 2-hydroxypropyl methacrylate, 2-hydroxyethyl acrylate, 2-hydroxypropyl acrylate, 2-hydroxybutyl methacrylate, dimethylaminoethyl methacrylate, diethylaminoethyl methacrylate, methacrylic acid, glycidyl methacrylate, ethylene glycol dimethacrylate, fumaric acid, dimethyl fumarate, diethyl fumarate, dipropyl fumarate, maleic acid, dimethyl maleate, diethyl maleate, dipropyl maleate, acrylonitrile, acrylamide, vinyl chloride, styrene, α-methylstyrene and the like. Amongst these, the preferred vinyl compounds are methyl methacrylate, ethyl methacrylate, propyl methacrylate, n-butyl methacrylate, isobutyl methacrylate, methyl(α-ethyl)acrylate, ethyl(α-ethyl)acrylate, propyl(α-ethyl)acrylate and butyl(α-ethyl) acrylate. Polyurethanes are easily impregnated with the aforesaid preferred vinyl compounds, and when the vinyl compound is polymerized within the polyurethane there is obtained a polishing pad of high hardness and high toughness. Specific examples of the polymers produced from the vinyl compounds in the present, invention (below referred to as the vinyl polymers) are polymethyl methacrylate, polyethyl methacrylate, polypropyl methacrylate, poly(n-butyl methacrylate), polyisobutyl methacrylate, polymethyl(α-ethyl)acrylate, polyethyl(α-ethyl)acrylate, polypropyl(α-ethyl)acrylate, polybutyl(α-ethyl)acrylate, poly(2-ethylhexyl methacrylate), polyisodecyl methacrylate, poly (n-lauryl methacrylate), poly(2-hydroxyethyl methacrylate), poly(2-hydroxypropyl methacrylate), poly(2-hydroxyethyl acrylate), poly(2-hydroxypropyl acrylate), poly(2-hydroxybutyl methacrylate), polydimethylaminoethyl methacrylate, polydiethylaminoethyl methacrylate, polymethacrylic acid, polyglycidyl methacrylate, polyethyleneglycol dimethacrylate, polyfumaric acid, polydimethyl fumarate, polydiethyl fumarate, polydipropyl fumarate, polymaleic acid, polydimethyl maleate, polydiethyl maleate, polydipropyl maleate, polyacrylonitrile, polyacrylamide, polyvinyl chloride, polystyrene, poly(α-methylstyrene) and the like. Of these, as preferred polymers, polymethyl methacrylate, polyethyl methacrylate, polypropyl methacrylate, poly(n-butyl methacrylate), polyisobutyl methacrylate, polymethyl(α-ethyl)acrylate, polyethyl(α-ethyl)acrylate, polypropyl(α-ethyl)acrylate and polybutyl (α-ethyl)acrylate can raise the polishing pad hardness, and are tough and can enhance the planarization properties. In the present invention, the vinyl polymer content is preferably at least 50 wt % and no more than 90 wt %. If it is less than 50 wt %, then the hardness of the polishing pad is lowered, which is undesirable. If it exceeds 90 wt %, the pad elasticity is impaired, so this is undesirable. The polyurethane or vinyl polymer content of the polishing pad can be measured by subjecting the polishing pad to pyrolysis gas chromatography/mass spectroscopy. With regard to the equipment employed in this procedure, as an example of the pyrolyzer, there is the Double Shot Pyrolyzer PY-2010D (produced by Frontier Lab Inc.) and as an example of the gas chromatograph/mass spectrometer, there is the TRIO-1 (produced by the VG Co.).

What is meant in the present invention by the polyurethane and the vinyl polymer being integrally incorporated is that they are not incorporated in a state in which the polyurethane phase and the polymer phase derived from the vinyl compound are separate from one-another. Expressed quantitatively, the infrared spectrum of the polishing pad observed with an infrared microspectroscope of spot size 50 μm has the infrared absorption bands of the polyurethane and the infrared absorption bands of the polymer derived from the vinyl compound, and the infrared spectrum is essentially the same in every location. As an example of the infrared microspectroscope here, there is the IRμs produced by the Spectra-Tech Co.

With regard to the method of producing the polishing pad of the present invention, a preferred method is the method whereby a previously-produced foamed polyurethane sheet having closed cells of average cell diameter no more than 1000 μm and having a density in the range 0.1 to 1.0 is swollen with the vinyl compound, after which the vinyl compound is made to polymerize within the foamed polyurethane. In this way, it is possible to produce a polishing pad with a closed cell structure in which the polyurethane and vinyl polymer are integrally coupled, and so it is possible to enhance local planarity and reduce the global step height. In a further preferred method, there is used a foamed polyurethane sheet material of average cell diameter no more than 500 μm and of density in the range 0.4 to 0.9. Of course, the combination and optimum amounts of the polyisocyanate, polyol, catalyst, foam stabilizer and foaming agent need to be determined in accordance with the target polishing pad hardness, cell diameter and foaming expansion factor.

As examples of methods for bringing about polymerisation of the vinyl compound within the foamed polyurethane, there are the method of polymerisation by light exposure using a photo radical initiator, the method of polymerisation by applying heat using a thermal radical initiator, and the method of polymerisation by means of an electron beam or by radiation.

In the polishing pad of the present invention, there can also be included abrasive particles. Examples of the abrasive particles are silica-based abrasive particles, aluminium oxide-based abrasive particles, cerium oxide-based abrasive particles and the like. It is desirable that the abrasive particles be incorporated into the foamed polyurethane beforehand.

The polishing pad obtained in the present invention can be used in the form of a composite polishing pad laminated to a sheet having cushioning properties. On a semiconductor substrate, besides local unevenness, there are also present somewhat larger undulations, and the polishing is most often carried out with a cushioning sheet placed beneath the hard polishing pad (on the polishing machine platen side) as a layer for absorbing these undulations.

Explanation is now given of the method of polishing a semiconductor substrate using the polishing pad of the present invention.

When carrying out polishing with the polishing pad of the present invention, if there is used a silica-based polishing agent, aluminium oxide-based polishing agent, cerium oxide-based polishing agent or the like as the polishing agent, it is possible to locally planarize insulating film or metal interconnect surface unevenness on the wafer and it is possible to reduce the global step height and suppress dishing. The polishing pad of the present invention is fixed to the rotating platen of the polishing machine and the wafer is held on the wafer carrier by means of a vacuum chuck system. The platen is made to rotate, and the wafer carrier is made to rotate in the same direction and pressed against the polishing pad. At this time, polishing agent is supplied between the polishing pad and wafer. The pressing pressure is adjusted by control of the force applied to the wafer carrier. Local planarity is obtained with a pressing pressure of 0.01 to 0.1 MPa, so this is preferred.

The polishing pad of the present invention makes it possible, when planarizing local unevenness on a semiconductor substrate, to reduce the global step height, suppress dishing and raise the polishing rate, and clogging or permanent set at the pad surface do not readily occur and there is no tendency for the polishing rate to deteriorate with elapse of time, so stable polishing is possible.

EXAMPLES

Below, the details of the invention are further explained along with examples. In these examples, the various properties were measured by the following methods.

1. Micro Rubber A-type Hardness

This was measured with a Kobunshi Keiki Co. (address: Shimotachiuri Muromachi Nishiiru, Kamigyo-ku, Kyoto) Micro Rubber Durometer MD-1.

The structure of the Micro Rubber Durometer MD-1 was as follows.

1.1 Sensor Region (1) loading system: cantilever plate spring (2) spring loading:

0 point 2.24 gf 100 point 33.85 gf (3) spring loading error: ±0.32 gf (4) indenter dimensions: cylindrical shape of diameter 0.16 mm, height 0.5 mm (5) displacement detection system: strain gauge (6) pressure bush foot dimensions:

outer diameter 4 mm, inner diameter 1.5 mm 1.2 Sensor Drive Region (1) drive system: vertical drive based on a stepping motor; descending rate control based on an air damper (2) vertical stroke: 12 mm (3) rate of descent: 10–30 mm/sec (4) height adjustment range: 0 to 67 mm (distance between sample table and sensor pressure face)

1.3 Sample Support (1) Sample support dimensions: diameter 80 mm, (2) Fine adjustment mechanism:

fine adjustment based on XY table and micrometer head; stroke 15 mm for both X and Y axes (3) Level regulator: main legs for level adjustment and round spirit level 2. Global Step Height (1) Test Wafer A 20 mm square die was-arranged on a 6 inch silicon wafer. In this 20 mm square die, there were arranged, in line and space fashion, aluminium interconnects of width 40 $\mu$m and height 1.2 $\mu$m at a spacing of 40 $\mu$m on the left half and aluminium interconnects of width 400 $\mu$m and height 1.2 $\mu$m at a spacing of 40 $\mu$m on the right half. Furthermore, a insulating film was formed on top at a thickness of 3 $\mu$m by CVD using tetraethoxysilane, and the global step height evaluation test wafer was thus prepared.

(2) Evaluation Method

The test wafer used for global step height evaluation was fitted to the polishing head of the polishing machine and made to rotate at 37 rpm. The composite polishing pad was fitted to the polishing machine platen and rotated at 36 rpm in the same direction as the direction of rotation of the polishing head. While supplying silica-based polishing agent at 200 ml/min, polishing was carried out for a specified time at a polishing pressure of 0.05 MPa. The global step height between the 40 $\mu$m width and 400 $\mu$m width interconnect regions on the global step height evaluation test wafer was measured.

3. Copper Interconnect Dishing (1) Test Wafer

On a 6 inch silicon wafer, grooves of width 100 $\mu$m and depth 0.7 $\mu$m were formed at a 100 $\mu$m spacing. On top, copper was formed at a thickness of 2 $\mu$m by a plating method and the test wafer for evaluation of the copper interconnect dishing thus produced.

(2) Evaluation Method

The test wafer for evaluation of the copper interconnect dishing was fitted to the polishing head of the polishing machine and rotated at 37 rpm. The composite polishing pad was fixed to the polishing machine platen and rotated at 36 rpm in the same direction as the direction of rotation of the polishing head. While supplying alumina-based polishing agent at 180 ml/min, polishing was carried out for a specified time at a polishing pressure of 0.04 MPa. The difference in the thickness of the central region of the copper interconnects and the thickness of the edge regions of the copper interconnects on the test wafer used for evaluation of the copper interconnect dishing was taken as the amount of dishing.

4. Oxide Film Removal Rate (1) Test Wafer

By forming a 1.2 $\mu$m thermally oxidized film on a 6 inch silicon wafer, the test wafer for evaluation of the oxide film removal rate was produced.

(2) Evaluation Method

A composite polishing pad was produced by sticking a non-rigid foamed polyurethane sheet of thickness 1.2 mm to the polishing pad. The test wafer for evaluation of the oxide film removal rate was fitted to the polishing head of the polishing machine and rotated at 37 rpm. The composite polishing pad was fixed to the platen of the polishing machine and rotated at 36 rpm in the same direction as the rotation direction of the polishing head. The polishing was carried out for a specified time at a polishing pressure of 0.05 MPa while supplying specified polishing agent at 225 ml/min, and the oxide film removal rate measured.

Next, ten such test wafers for evaluation of the oxide film removal rate were subjected to the polishing treatment and the oxide removal rate measured for the $10^{th}$ wafer.

Furthermore, the polishing of 1000 wafers was carried out with the surface of the composite polishing pad being given an approximately 0.5 μm dressing with a diamond dresser every $10^{th}$ time, after which the polishing rate for the $1000^{th}$ wafer was measured.

Example 1

30 parts by weight of polypropylene glycol, 40 parts by weight of diphenylmethane diisocyanate, 0.8 parts by weight of water, 0.3 parts by weight of triethylamine, 1.7 parts by weight of silicone foam stabilizer and 0.09 parts by weight of tin octylate were mixed together in an RIM moulding machine, then discharged into a mould and pressure moulding carried out to produce a foamed polyurethane sheet of thickness 1.5 mm (micro rubber A-type hardness=50°, density: 0.51, average diameter of closed cells: 40 μm). Said polyurethane sheet was then soaked for 15 hours in methyl methacrylate to which 0.1 parts by weight of azobisisobutyronitrile had been added. The foamed polyurethane sheet which had been swollen with methyl methacrylate was sandwiched between glass plates and heated for 24 hours at 70° C. After heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 98°, the density: 0.75, average closed cell diameter: 60 μm, and the content of the polymethyl methacrylate in the polishing pad was 82 wt %.

Using a silica-based polishing agent, with a polishing time of 10 minutes the oxide film removal rate was 1020 Å/min. The oxide film removal rate for the 10th wafer was 950 Å/min. After 1000 wafers, the removal rate was 940 Å/min, so there was little fall.

When the global step height was evaluated for a polishing time of 7 minutes, the global step height between the 40 μm width and 400 μm width interconnect regions of the global step height evaluation test wafer was low at 0.02 μm.

When the copper interconnect dishing was evaluated at a polishing time of 10 minutes, the thickness of the copper interconnect central region of the test wafer used for copper interconnect dishing evaluation was 0.65 μm and that of the copper interconnect edge regions was 0.70 μm, so the amount of dishing was low at 0.05 μm.

Example 2

30 parts by weight of polypropylene glycol, 40 parts by weight of diphenylmethane diisocyanate, 1 part by weight of water, 0.2 parts by weight of triethylamine, 1.8 parts by weight of silicone foam stabilizer and 0.08 parts by weight of tin octylate were mixed together in an RIM moulding machine, then discharged into a mould and pressure moulding carried out to produce a foamed polyurethane sheet of thickness 2 mm (micro rubber A-type hardness=50°, density: 0.4, average diameter of closed cells: 60 μm). Said polyurethane sheet was soaked for 24 hours in monomer liquid comprising 80 parts by weight of methyl methacrylate and 20 parts by weight of divinyl benzene to which 0.1 part by weight of azobisisobutyronitrile had been added. The foamed polyurethane sheet swollen with monomer was sandwiched between glass plates and heated for 24 hours at 70° C. After the heating, the sheet was removed from the glass plates and dried under vacuum at 50° C. Both faces of the rigid foamed sheet obtained were subjected to grinding to produce a 1.5 mm polishing pad. The micro rubber A-type hardness of the polishing pad obtained was 98°, the density=0.81, the average closed cell diameter: 80 μm, and the content of the methyl methacrylate/divinyl benzene copolymer in the polishing pad was 85 wt %.

Using a silica-based polishing agent, with a polishing time of 10 minutes the oxide film removal rate was 1500 Å/min. The oxide film removal rate for the 10th wafer was 1400 Å/min. After 1000 wafers, the removal rate was 1380 Å/min, so there was little fall.

When the global step height was evaluated for a polishing time of 4.5 minutes, the global step height was low at 0.01 μm.

When the copper interconnect dishing was evaluated at a polishing time of 6.5 minutes, the thickness of the copper interconnect central region of the test wafer used for copper interconnect dishing evaluation was 0.66 μm and the thickness of the edge regions was 0.68 μm, so the amount of dishing was low at 0.02 μm.

Example 3

30 parts by weight of polytetramethylene ether glycol, 40 parts by weight of tolylene diisocyanate, 0.5 parts by weight of water, 0.2 parts by weight of tripropylamine, 1.8 parts by weight of silicone foam stabilizer and 0.08 parts by weight of tin octylate were mixed together in an RIM moulding machine, then discharged into a mould and pressure moulding carried out to produce a foamed polyurethane sheet of thickness 3 mm (micro rubber A-type hardness=50°, density: 0.7, average diameter of closed cells: 40 μm). Said foamed polyurethane sheet was soaked for 24 hours in monomer liquid comprising 80 parts by weight of methyl methacrylate and 20 parts by weight of diethylene glycol dimethacrylate to which 0.1 part by weight of azobisisobutyronitrile had been added. The foamed polyurethane sheet swollen with monomer was sandwiched between glass plates and heated for 24 hours at 70° C. After the heating, the sheet was removed from the glass plates and dried under vacuum at 50° C. Both faces of the rigid foamed sheet obtained were subjected to grinding to produce a 1.0 mm polishing pad. The micro rubber A-type hardness of the polishing pad obtained was 99°, the density=0.85, average closed cell diameter: 60 μm, and the content of methyl methacrylate/diethylene glycol dimethacrylate copolymer was 72 wt %. A composite polishing pad was produced by sticking together said polishing pad and a non-rigid foamed polyurethane sheet of thickness 1.2 mm.

Using a silica-based polishing agent, with a polishing time of 10 minutes the oxide film removal rate was 900 Å/min. The oxide film removal rate for the 10th wafer was 850 Å/min. After 1000 wafers, the removal rate was 800 Å/min, and so there was little fall.

When the global step height was evaluated for a polishing time of 8 minutes, it was low at 0.04 μm.

When the copper interconnect dishing was evaluated at a polishing time of 11 minutes, the thickness of the copper interconnect central region of the test wafer used for copper interconnect dishing evaluation was 0.66 μm and the thickness of the copper interconnect edge regions was 0.69 μm, so the amount of dishing was low at 0.03 μm.

Example 4

30 parts by weight of polypropylene glycol, 40 parts by weight of diphenylmethane diisocyanate, 0.8 parts by weight of water, 0.3 parts by weight of triethylamine, 1.7 parts by weight of silicone foam stabilizer, 0.09 parts by weight of tin octylate and 10 parts by weight of colloidal silica of average particle size 0.2 μm were mixed together in an RIM moulding machine, then discharged into a mould and pressure moulding carried out to produce a foamed polyurethane sheet of thickness 1.5 mm (micro rubber A-type hardness=70°, density: 0.91, average diameter of closed cells: 50 μm). Said foamed polyurethane sheet was soaked for 15 hours in methyl methacrylate to which 0.1 part by weight of azobisisobutyronitrile had been added. The foamed pplyurethane sheet swollen with methyl methacrylate was sandwiched between glass plates and heated for 24 hours at 70° C. After the heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 99°, the density: 1.0, the average closed cell diameter: 70 μm, and the content of polymethyl methacrylate was 82 wt %.

When polishing was carried out for 10 minutes at a polishing pressure of 0.05 MPa while supplying potassium hydroxide of pH 10 as the polishing agent at 225 ml/minute, the oxide film removal rate was 1300 Å/min. The oxide film removal rate for the 10th wafer was 1200 Å/min. After 1000 wafers, the removal rate was 1150 Å/min, so there was little fall.

When polishing was carried out for 5 minutes at a polishing pressure of 0.05 MPa while supplying the potassium hydroxide of pH 10 at 200 ml/minute, the global step height was low at 0.03 μm.

Example 5

30 parts by weight of polypropylene glycol, 40 parts by weight of diphenylmethane diisocyanate, 1.2 parts by weight of water, 0.3 parts by weight of triethylamine, 1.7 parts by weight of silicone foam stabilizer and 0.09 parts by weight of tin octylate were mixed together in an RIM moulding machine, then discharged into a mould and pressure moulding carried out to produce a foamed polyurethane sheet of thickness 1.5 mm (micro rubber A-type hardness=50°, density: 0.51, average diameter of closed cells: 40 μm). Said polyurethane sheet was soaked for 10 hours in methyl methacrylate to which 0.1 parts by weight of azobisisobutyronitrile had been added. The foamed polyurethane sheet swollen with methyl methacrylate was sandwiched between glass plates and heated for 24 hours at 70° C. After the heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 85°, density: 0.75, average closed cell diameter: 60 μm, and the content of the polymethyl methacrylate in the polishing pad was 75 wt %.

Using a silica-based polishing agent, with a polishing time of 10 minutes the oxide film removal rate was 980 Å/min. The oxide film removal rate for the 10th wafer was 930 Å/min. After 1000 wafers, the removal rate was 900 Å/min, so there was little fall.

When the global step height was evaluated for a polishing time of 7 minutes, the global step height between the 40 μm width and 400 μm width interconnect regions of the global step height evaluation test wafer was low at 0.05 μm.

When the copper interconnect dishing was evaluated at a polishing time of 10 minutes, the thickness of the copper interconnect central region of the test wafer used for copper. interconnect dishing evaluation was 0.65 μm and that of the copper interconnect edge regions was 0.70 μm, so the amount of dishing was low at 0.05 μm.

Example 6

30 parts by weight of polypropylene glycol, 40 parts by weight of diphenylmethane diisocyanate, 1.5 parts by weight of water, 0.4 parts by weight of triethylamine, 1.6 parts by weight of silicone foam stabilizer and 0.10 part by weight of tin octylate were mixed together in an RIM moulding machine, then discharged into a mould and pressure moulding carried out to produce a foamed polyurethane sheet of thickness 1.5 mm (micro rubber A-type hardness=50°, density: 0.40, average diameter of closed cells: 150 μm). Said polyurethane sheet was soaked for 8 hours in methyl methacrylate to which 0.1 part by weight of azobisisobutyronitrile had been added. The foamed polyurethane sheet swollen with methyl methacrylate was sandwiched between glass plates and heated for 24 hours at 70° C. After the heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 98°, the density: 0.70, average closed cell diameter: 200 μm, and the content of the polymethyl methacrylate in the polishing pad was 82 wt %.

Using a silica-based polishing agent, with a polishing time of 10 minutes the oxide film removal rate was 1050 Å/min. The oxide film removal rate for the 10th wafer was 980 Å/min. After 1000 wafers, the removal rate was 950 Å/min, so there was little fall.

When the global step height was evaluated for a polishing time of 7 minutes, the global step height between the 40 μm width and 400 μm width interconnect regions of the global step height evaluation test wafer was low at 0.02 μm.

When the copper interconnect dishing was evaluated for a polishing time of 10 minutes, the thickness of the copper interconnect central region on the test wafer used for copper interconnect dishing evaluation was 0.65 μm and that of the copper interconnect edge regions was 0.70 μm, so the amount of dishing was low at 0.05 μm.

Example 7

30 parts by weight of polypropylene glycol, 40 parts by weight of diphenylmethane diisocyanate, 1.8 parts by weight of water, 0.5 parts by weight of triethylamine, 1.7 parts by weight of silicone foam stabilizer and 0.09 parts by weight of tin octylate were mixed together in an RIM moulding machine, then discharged into a mould and pressure moulding carried out to produce a foamed polyurethane sheet of thickness 1.5 mm (degree of micro rubber hardness=50°, density: 0.51, average diameter of closed cells: 240 μm). Said foamed polyurethane sheet was soaked for 7 hours in methyl methacrylate to which 0.1 part by weight of azobisisobutyronitrile had been added. The foamed polyurethane sheet swollen with methyl methacrylate was sandwiched between glass plates and heated for 24 hours at 70° C. After the heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 98°, density: 0.70, average closed cell diameter: 300 μm, and the content of the polymethyl methacrylate in the polishing pad was 85 wt %.

Using a silica-based polishing agent, with a polishing time of 10 minutes the oxide film removal rate was 1080 Å/min. The oxide film removal rate for the 10th wafer was 990 Å/min. After 1000 wafers, the removal rate was 960 Å/min, so there was little fall.

When the global step height was evaluated for a polishing time of 7 minutes, the global step height between the 40 μm width and 400 μm width interconnect regions of the global step height evaluation test wafer was low at 0.02 μm.

When the copper interconnect dishing was evaluated at a polishing time of 10 minutes, the thickness of the copper interconnect central region on the test wafer used for copper interconnect dishing evaluation was 0.65 μm and that of the copper interconnect edge regions was 0.70 μm, so the amount of dishing was low at 0.05 μm.

Example 8

30 parts by weight of polypropylene glycol, 40 parts by weight of diphenylmethane diisocyanate, 2.0 parts by weight of water, 0.5 parts by weight of triethylamine, 1.7 parts by weight of silicone foam stabilizer and 0.09 parts by weight of tin octylate were mixed together in an RIM moulding machine, then discharged into a mould and pressure moulding carried out to produce a foamed polyurethane sheet of thickness 1.5 mm (degree of micro rubber hardness=50°, density: 0.45, average diameter of closed cells: 350 μm). Said polyurethane sheet was soaked for 12 hours in methyl methacrylate to which 0.1 part by weight of azobisisobutyronitrile had been added. The foamed polyurethane sheet swollen with methyl methacrylate was sandwiched between glass plates and heated for 24 hours at 70° C. After the heating, the sheet was removed from the glass plates and dried under vacuum at 50° C. Both faces of the rigid foamed sheet obtained were subjected to grinding to produce a polishing pad of thickness 1.2 mm. The micro rubber A-type hardness of the polishing pad obtained was 98°, density: 0.77, average closed cell diameter: 480 μm, and the content of the polymethyl methacrylate in the polishing pad was 81 wt %.

Using a silica-based polishing agent, with a polishing time of 10 minutes the oxide film removal rate was 1030 Å/min. The oxide film removal rate for the 10th wafer was 960 Å/min. After 1000 wafers, the removal rate was 940 Å/min, so there was little fall.

When the global step height was evaluated for a polishing time of 7 minutes, the global step height between the 40 μm width and 400 μm width interconnect regions of the global step height evaluation test wafer was low at 0.03 μm.

When the copper interconnect dishing was evaluated at a polishing time of 10 minutes, the thickness of the copper interconnect central region on the test wafer used for copper interconnect dishing evaluation was 0.65 μm and that of the copper interconnect edge regions was 0.70 μm, so the amount of dishing was low at 0.04 μm.

Comparative Example 1

78 parts by weight of polyether-based urethane polymer (Adiprene L-325, produced by Uniroyal) and 20 parts by weight of 4,4'-methylene-bis2-chloroaniline were mixed together in an RIM mixing machine, then 1.8 parts by weight of hollow polymer microspheres (Expancel 551 DE) mixed-in, and a rigid foamed polyurethane sheet of thickness 12 mm produced (micro rubber A-type hardness=92°, density=0.78, average diameter of closed cells: 30 μm). This rigid foamed polyurethane sheet was sliced to produce polishing pads of thickness 1.2 mm.

When polishing was carried out for 10 minutes while supplying silica-based polishing agent at 225 ml/minute, the oxide film removal rate was 1100 Å/minute. The oxide film removal rate for the 10th wafer was 500 Å/minute. After 1000 wafers, the removal rate was 500 Å/minute, and so the fall was considerable.

When the global step height was evaluated for a polishing time of 7 minutes, the global step height was large at 0.1 μm.

When the copper interconnect dishing was evaluated, the thickness of the copper interconnect central region on the test wafer used for copper interconnect dishing evaluation was 0.40 μm and that of the copper interconnect edge regions was 0.68 μm, so the amount of dishing was high at 0.28 μm.

Comparative Example 2

78 parts by weight of a polyether-based urethane polymer (Adiprene L-325, produced by Uniroyal) and 4.64 parts by weight of ethylene glycol were mixed together in an RIM mixing machine, then 1.5 parts by weight of hollow polymer microspheres (Expancel 551 DE) mixed-in, and a rigid foamed polyurethane of thickness 12 mm produced (micro rubber A-type hardness=50°, density=0.75, average diameter of closed cells: 30 μm). This foamed polyurethane sheet was sliced to produce polishing pads of thickness 1.2 mm.

When polishing was carried out for 10 minutes while supplying silica-based polishing agent at 225 ml/minute, the oxide film removal rate was 400 Å/minute. The oxide film removal rate for the 10th wafer was 300 Å/minute. After 1000 wafers, the polishing rate was 200 Å/minute, so the fall was considerable.

The global step height was evaluated for a polishing time of 19 minutes, but the protrusions on the 40 μm and 400 μm lines were not lowered below about 0.2μ, so planarity was not obtained.

Comparative Example 3

78 parts by weight of polyether-based urethane polymer (Adiprene L-325, produced by Uniroyal), 10 parts by weight of 4,4'-methylene-bis2-chloroaniline and 2.32 parts by weight of ethylene glycol were mixed together in an RIM mixing machine, then 1.6 parts by weight of hollow polymer microspheres (Expancel 551 DE) mixed-in, and a rigid foamed polyurethane of thickness 12 mm produced (micro rubber A-type hardness=70°, density=0.78, average diameter of closed cells: 30 μm). This foamed polyurethane sheet was sliced to produce polishing pads of thickness 1.2 mm.

When polishing was carried out for 10 minutes while supplying silica-based polishing agent at 225 ml/minute, the oxide film removal rate was 800 Å/minute. The oxide film removal rate for the 10th wafer was 600 Å/minute. After 1000 wafers, the polishing rate was 400 Å/minute, so the fall was considerable.

The global step height was evaluated for a polishing time of 9 minutes, but the protrusions on the 40 μm and 400 μm lines were not lowered below about 0.1μ, so planarity was not obtained.

INDUSTRIAL APPLICABILITY

By means of the present invention, there is provided a polishing pad which, in the mechanical planarization process, whereby the surface of the insulating layers or metal interconnects formed on the silicon substrate are smoothed by polishing, the polishing rate is high, the global step height is low, dishing does not readily occur at the metal interconnects, clogging or permanent set at the surface regions do not tend to occur, and the polishing rate is stable.

TABLE 1

| | Polyurethane/Vinyl Polymer Polishing Pad Structure | | | | | Polishing Performance | | | | |
|---|---|---|---|---|---|---|---|---|---|---|
| | Micro Rubber | | | Vinyl Polymer | | Polishing Rate (Å/minute) | | | | |
| | A-type | | Average Closed | Monomer | | | After Polishing | | Global Step | Amount of |
| | Hardness (°) | Density (g/cm$^3$) | Cell Diameter (μm) | Components (weight ratio) | Content (weight %) | Initial | 10th Wafer | 1000th Wafer | Height (μm) | Dishing (μm) |
| Example 1 | 98 | 0.78 | 60 | MMA (100) | 82 | 1020 | 950 | 940 | 0.02 | 0.05 |
| Comparative Example 1 | 92 | 0.78 | 30 | — | 0 | 1100 | 500 | 500 | 0.10 | 0.28 |
| Comparative Example 2 | 50 | 0.75 | 30 | — | 0 | 400 | 300 | 200 | planarity not obtained | — |
| Comparative Example 3 | 78 | 0.75 | 30 | — | 0 | 800 | 600 | 400 | planarity not obtained | — |
| Example 2 | 98 | 0.81 | 80 | MMA/DVB (80/20) | 85 | 1500 | 1400 | 1380 | 0.01 | 0.02 |
| Example 3 | 99 | 0.85 | 60 | MMA/DEGDMA (80/20) | 72 | 900 | 850 | 800 | 0.04 | 0.03 |
| Example 4 | 99 | 1.0 | 70 | MMA | 82 | 1300 | 1200 | 1150 | 0.03 | — |
| Example 5 | 85 | 0.75 | 60 | MMA (100) | 75 | 980 | 930 | 900 | 0.05 | 0.10 |
| Example 6 | 98 | 0.70 | 200 | MMA (100) | 82 | 1050 | 980 | 950 | 0.02 | 0.04 |
| Example 7 | 98 | 0.70 | 300 | MMA (100) | 85 | 1080 | 990 | 960 | 0.02 | 0.04 |
| Example 8 | 98 | 0.77 | 480 | MMA (100) | 81 | 1030 | 960 | 940 | 0.03 | 0.04 |

MMA: methyl methacrylate
DBV: divinylbenzene
DEGDMA: diethylene glycol dimethacrylate

What is claimed is:

1. A polishing pad of micro rubber A-type hardness at least 80°, which contains polyurethane and polymer produced from a vinyl compound, which possesses closed cells and which comprises at least 50 wt % but no more than 90 wt % of the polymer produced from the vinyl compound.

2. A polishing pad according to claim 1, wherein the polyurethane and polymer polymerized from a vinyl compound are integrally incorporated.

3. A method of polishing a semiconductor substrate, wherein a polishing pad according to claim 1 or a composite pad with this as a structural element is fixed to a polishing platen, and the semiconductor substrate polished while interposing polishing agent between said polishing pad and the semiconductor substrate fixed to the polishing head.

4. A polishing pad of micro rubber A-type hardness at least 80°, which contains polyurethane and polymer produced from a vinyl compound, which possesses closed cells and where the vinyl compound is represented by $CH_2{=}CR_1COOR_2$ ($R_1$=methyl group or ethyl group, $R_2$=methyl group, ethyl group, propyl group or butyl group).

5. A polishing pad according claim 1, wherein the micro rubber hardness is at least 90°.

6. A polishing pad according claim 1, wherein the density is from 0.4 to 1.1.

7. A polishing pad according claim 1, wherein the density is from 0.6 to 0.9.

8. A polishing pad according claim 1, wherein the density is from 0.65 to 0.85.

9. A polishing pad according claim 1, wherein the average cell diameter of the closed cells is no more than 1000 μm.

10. A polishing pad according claim 1, wherein the average cell diameter of the closed cells is no more than 500 μm.

11. A polishing pad according claim 1, wherein the average cell diameter of the closed cells is no more than 300 μm.

12. A composite polishing pad formed by laminating a polishing pad according to claim 1 and a cushioning sheet.

13. A method of producing a polishing pad, wherein a foamed polyurethane sheet having closed cells of average cell diameter no more than 1000 μm and of density in the range 0.1 to 1.0 is impregnated with vinyl compound, after which the vinyl compound is polymerized.

14. A method of producing a polishing pad according to claim 13, wherein the vinyl compound is represented by $CH_2{=}CR_1COOR_2$ ($R_1$=methyl group or ethyl group, $R_2$=methyl group, ethyl group, propyl group or butyl group).

* * * * *